US008563886B2

(12) United States Patent
Chen

(10) Patent No.: US 8,563,886 B2
(45) Date of Patent: Oct. 22, 2013

(54) KEY STRUCTURE WITH SCISSORS-TYPE CONNECTING MEMBER

(75) Inventor: Bo-An Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 235 days.

(21) Appl. No.: 13/079,658

(22) Filed: Apr. 4, 2011

(65) Prior Publication Data

US 2012/0211340 A1 Aug. 23, 2012

(30) Foreign Application Priority Data

Feb. 18, 2011 (TW) ..... 100105382 A

(51) Int. Cl.
*H01H 13/70* (2006.01)

(52) U.S. Cl.
USPC ..... 200/344; 200/345; 200/243; 400/490; 400/495

(58) Field of Classification Search
USPC ..... 200/344
See application file for complete search history.

(56) References Cited

U.S. PATENT DOCUMENTS 6,642,466 B1 * 11/2003 Lu ..... 200/344
7,173,200 B2 * 2/2007 Yoneyama ..... 200/344
2011/0024278 A1 * 2/2011 Wang ..... 200/344

* cited by examiner

*Primary Examiner* — Renee S Luebke
*Assistant Examiner* — Ahmed Saeed
(74) *Attorney, Agent, or Firm* — Kirton McConkie; Evan R. Witt

(57) ABSTRACT

A key structure with a scissors-type connecting member is provided. The scissors-type connecting member includes a first frame and a second frame. The first frame has a bulge. The second frame has a recess. The height of the bulge is smaller than the length of the recess entrance. The length of the recess bottom surface is greater than the length of the recess entrance. After the bulge of the first frame is introduced into the recess of the second frame, since the length of the recess bottom surface is greater than the length of the recess entrance, the possibility of detaching the bulge from the recess during the operation of the scissors-type connecting member will be minimized.

18 Claims, 10 Drawing Sheets

KEY STRUCTURE WITH SCISSORS-TYPE CONNECTING MEMBER

FIELD OF THE INVENTION

The present invention relates to a key structure, and more particularly to a key structure of a keyboard device.

BACKGROUND OF THE INVENTION

Generally, the common input device of a computer includes for example a mouse device, a keyboard device, a trackball device, and the like. Via the keyboard device, the user may directly input characters and commands into the computer. As a consequence, most users and most manufacturers of the input devices pay much attention to the development of the keyboard devices.

Hereinafter, the configurations and the functions of a conventional keyboard device will be illustrated with reference to FIG. 1. FIG. 1 is a schematic view illustrating the outward appearance of a conventional keyboard device. As shown in FIG. 1, plural keys 10 are installed on the surface of the conventional keyboard device 1. These keys 10 are classified into some types, e.g. ordinary keys, numeric keys and function keys. When one or more keys 10 are depressed by the user's fingers, a corresponding signal is issued to the computer, and thus the computer executes a function corresponding to the depressed key or keys. For example, when the ordinary keys are depressed, corresponding English letters or symbols are inputted into the computer system. In addition, the function keys (e.g. F1~F12) can be programmed to cause corresponding application programs to provide certain functions.

Hereinafter, the components of a key structure of the conventional keyboard device will be illustrated with reference to FIG. 2. FIG. 2 is a schematic exploded view illustrating a key structure of a conventional keyboard device. As shown in FIG. 2, the key structure 2 comprises a keycap 21, a scissors-type connecting member 22, an elastic element 23, a membrane switch 24 and a base plate 25. The keycap 21 may be touched and depressed by the user. The keycap 21 is connected with the scissors-type connecting member 22. The scissors-type connecting member 22 is arranged between the keycap 21 and the base plate 25. In addition, the scissors-type connecting member 22 is connected with the keycap 21 and the base plate 25. The scissors-type connecting member 22 comprises an inner frame 221 and an outer frame 222. The inner frame 221 has an inner frame shaft 2211. Corresponding to the inner frame shaft 2211, an outer frame hole 2221 is formed in the outer frame 222. By penetrating the inner frame shaft 2211 through the outer frame hole 2221, the inner frame 221 and the outer frame 222 are connected with each other, and the inner frame 221 may be swung with respect to the outer frame 222. The membrane switch 24 is arranged on the base plate 25. The elastic element 23 is arranged between the keycap 21 and the membrane switch 24. When the keycap 21 is depressed, the elastic element 23 is deformed downwardly to trigger the membrane switch 24, so that the membrane switch 24 generates an electronic signal.

In a case that the key structure 2 has been not depressed, the keycap 21 of the key structure 2 is located at a first height (not shown). Whereas, when the key structure 2 is depressed, a depressing force is exerted on the keycap 21, and the elastic element 23 is compressed in response to the depressing force. As the keycap 21 is depressed, the inner frame 221 and the outer frame 222 of the scissors-type connecting member 22 are swung, so that the inner frame 221 and the outer frame 222 are parallel with each other. At the same time, the elastic element 23 is deformed downwardly to trigger the membrane switch 24, so that the membrane switch 24 generates an electronic signal. In addition, the keycap 21 of the key structure 2 is lowered from the first height to a second height (not shown). The difference between the first height and the second height indicates the travel distance of the key structure 2.

In a case that the depressing force exerted on the keycap 21 is eliminated, the keycap 21 will be moved upwardly is response to the restoring force of the elastic element 23. As the keycap 21 is moved upwardly, the inner frame 221 and the outer frame 222 are transmitted by the keycap 21 to rotate. As such, the keycap 21 is returned to its original position where the keycap 21 has not been depressed (i.e. at the first height).

In designing the scissors-type connecting member 22, the keycap 21 needs to be returned to its original position (i.e. at the first height) after the depressing force exerted on the keycap 21 is eliminated. Generally, the elastic element 23 provides the restoring force to push the keycap 21 back to its original position. Moreover, the inner frame 221 and the outer frame 222 need to cooperate with each other to precisely control the upward moving action of the keycap 21 in the vertical direction. In other words, the scissors-type connecting member 22 is a very important factor that influences the quality and the use life of the key structure 2.

Moreover, for combining the inner frame 221 with the outer frame 222, the user needs to prop open the outer frame 222 to widen the distance between the two outer frame holes 2221, which are formed in bilateral sides of the outer frame 222. As such, the inner frame shaft 2211 can be successfully inserted into corresponding outer frame holes 2221 to combine the inner frame 221 and the outer frame 222 together. The procedure of propping-open the outer frame 222 increases the assembling time of the key structure 2 and is detrimental to the throughput of the keyboard device. On the other hand, if the external force used to prop open the outer frame 222 is improper, the outer frame 222 is readily damaged or permanently distorted. Under this circumstance, the yield is reduced and the fabricating cost is increased. Moreover, since the outer frame 222 has the outer frame holes 2221, the whole structure of the outer frame 222 becomes weak and is easily damaged. In other words, the scissors-type connecting member 22 is not suitable for slimness of the key structure 2.

For solving the above drawbacks of the conventional key structure 2, another scissors-type connecting member is disclosed. FIG. 3 is an exploded view illustrating another scissors-type connecting member of the conventional key structure. As shown in FIG. 3, the scissors-type connecting member 3 comprises an inner frame 31 and an outer frame 32. The inner frame 31 has an inner bulge 311, an inner recess 312, a first inner shaft 313 and a second inner shaft 314. The outer frame 31 has an outer recess 321, an outer bulge 322, a first outer shaft 323 and a second outer shaft 324. For combining the inner frame 31 with the outer frame 32, the inner bulge 311 is inserted and received within the outer recess 321, and the outer bulge 322 is inserted and received within the inner recess 312. In such way, the inner frame 31 and the outer frame 32 are combined together to produce the scissors-type connecting member 3. In addition, the first inner shaft 313 of the inner frame 31 is connected with a base plate (not shown), and the second inner shaft 314 of the inner frame 31 is connected with a keycap (not shown). On the other hand, the first outer shaft 323 of the outer frame 32 is connected with the keycap, and the second outer shaft 324 of the outer frame 32 is connected with the base plate.

In the conventional scissors-type connecting member 3, the inner frame 31 and the outer frame 32 are combined together by inserting the inner bulge 311 and the outer bulge 322 into the outer recess 321 and the inner recess 312, respectively. In such way, it is not necessary to prop open the outer frame during the process of assembling the conventional scissors-type connecting member 3. However, since it is easy to respectively insert the inner bulge 311 and the outer bulge 322 into the outer recess 321 and the inner recess 312, the inner bulge 311 and the outer bulge 322 are easily detached from the outer recess 321 and the inner recess 312, respectively. That is, the inner frame 31 and the outer frame 32 are readily separated from each other. From the above discussion, although it is not necessary to open the outer frame during the process of assembling the conventional scissors-type connecting member 3, the possibility of separating the outer frame from the inner frame is high.

SUMMARY OF THE INVENTION

The present invention provides a key structure with a scissors-type connecting member, which is easily assembled and difficultly detached.

In accordance with an aspect of the present invention, there is provided a key structure with a scissors-type connecting member. The key structure includes a base plate, a keycap and the scissors-type connecting member. The keycap is disposed over the base plate. The scissors-type connecting member is arranged between the base plate and the keycap for connecting the base plate with the keycap, so that the keycap is moved upwardly or upwardly with respect to the base plate. The scissors-type connecting member includes a first frame and a second frame. The first frame has a bulge formed on a sidewall of the first frame. The bulge includes a bulge top surface and a bulge bottom surface. A bulge height between the bulge top surface and the bulge bottom surface is smaller than a bulge width of the bulge. The second frame is connected with the first frame, and includes a recess in a sidewall of the second frame. The bulge is accommodated within the recess when the first frame and the second frame are combined together. The recess has a recess entrance, a first recess sidewall and a recess bottom surface. A length of the recess entrance is greater than the bulge height. The length of the recess entrance is smaller than a recess width of the recess. The length of the recess entrance is smaller than the bulge width. During the first frame is combined with the second frame, the first recess sidewall is pushed by a first bulge curved part of the bulge to result in interference fit, and the first recess sidewall is subject to deformation to facilitate combining the first frame and the second frame together.

In an embodiment, the bulge further includes a first bulge sidewall, a second bulge sidewall and a second bulge curved part. The first bulge sidewall is arranged between the bulge top surface and the first bulge curved part. The second bulge sidewall is arranged at a first side of the bulge top surface. The second bulge curved part is arranged between the bulge bottom surface and the second bulge sidewall. During the first frame is combined with the second frame, the recess bottom surface is pushed by the second bulge curved part to result in interference fit. A distance between the first bulge curved part and the second bulge curved part is defined as the bulge width.

In an embodiment, the first recess sidewall is arranged at a first side of the recess entrance. During the first frame is combined with the second frame and the first frame is swung with respect to the second frame, the first bulge curved part of the bulge is stopped by the first recess sidewall, thereby preventing detachment of the bulge from the recess.

In an embodiment, the recess further includes a second recess sidewall, a first recess curved part and a second recess curved part. The second recess sidewall is arranged at a second side of the recess entrance. During the first frame is combined with the second frame, the second recess sidewall is pushed by a third bulge curved part of the bulge to result in interference fit. The first recess curved part is arranged between the first recess sidewall and the recess bottom surface. The second recess curved part is arranged between the second recess sidewall and the recess bottom surface. A distance between the first recess curved part and the second recess curved part is defined as the recess width.

In an embodiment, each of the first bulge curved part, the second bulge curved part, the first recess curved part and the second recess curved part is a beveled round corner or a sharp corner.

In an embodiment, for combining the first frame with the second frame, the second bulge curved part is firstly introduced into the recess entrance and then the first frame is rotated to allow the first recess sidewall to be pushed by the first bulge curved part of the bulge to result in interference fit, so that the first recess sidewall is subject to deformation to facilitate combining the first frame and the second frame together.

In an embodiment, a protrusion is further formed on the first recess sidewall and arranged beside the recess entrance. During the first frame is combined with the second frame, the protrusion is pushed by the first bulge curved part of the bulge to result in deformation, so that the first curved part is allowed to pass through the protrusion to be located between the protrusion and the recess bottom surface to facilitate combining the first frame and the second frame together.

In an embodiment, the second frame further includes an auxiliary bulge, which is arranged between the sidewall of the second frame and beside the recess. During the first frame is swung with respect to the second frame, the auxiliary bulge is in contact with the bulge.

In an embodiment, the first frame further includes an auxiliary recess, which is arranged between the sidewall of the first frame and beside the bulge. During the first frame is swung with respect to the second frame, the auxiliary bulge is accommodated within the auxiliary recess.

In an embodiment, the first frame is an inner frame, the second frame is an outer frame, the first frame is disposed within the second frame, and the first frame has a central hollow portion.

In an embodiment, the first frame is an outer frame, the second frame is an inner frame, the second frame is disposed within the first frame, and the second frame has a central hollow portion.

In an embodiment, the key structure further includes a membrane switch and an elastic element. The membrane switch is disposed on the base plate. When the membrane switch is triggered, the membrane switch generates a key signal. The elastic element is disposed on the membrane switch. A lower portion of the elastic element is in contact with the membrane switch. The elastic element is penetrated through the scissors-type connecting member. An upper portion of the elastic element is in contact with the keycap. When the elastic element is pushed by the keycap, the membrane switch is triggered by the elastic element. Whereas, when a depressing force exerted on the keycap is eliminated, an elastic force provided by the elastic element is exerted on the keycap.

In an embodiment, when the keycap is depressed, the first frame is swung with respect to the second frame, so that the scissors-type connecting member is changed from an open-scissors state to a folded state and the elastic element is pushed by the keycap to trigger the membrane switch to generate the key signal. When the depressing force exerted on the keycap is eliminated, the elastic force provided by the elastic element is exerted on the keycap, and the first frame is swung with respect to the second frame, so that the scissors-type connecting member is changed from the folded state to the open-scissors state and the keycap is moved to an original position.

In accordance with another aspect of the present invention, there is provided a key structure with a scissors-type connecting member. The key structure includes a base plate, a keycap and the scissors-type connecting member. The keycap is disposed over the base plate. The scissors-type connecting member is arranged between the base plate and the keycap for connecting the base plate with the keycap, so that the keycap is moved upwardly or upwardly with respect to the base plate. The scissors-type connecting member includes a first frame and a second frame. The first frame has an elliptic bulge formed on a sidewall of the first frame. The elliptic bulge has a major axis and a minor axis, wherein the minor axis is shorter than the major axis. The second frame is connected with the first frame, and includes a recess in a sidewall of the second frame. The elliptic bulge is accommodated within the recess when the first frame and the second frame are combined together. The recess has a recess entrance, a first recess sidewall and a recess bottom surface. A length of the recess entrance is greater than a length of the minor axis. The length of the recess entrance is smaller than a recess width of the recess. The length of the recess entrance is smaller than a length of the major axis. During the first frame is combined with the second frame, the first recess sidewall is pushed by a first major axis end of the elliptic bulge to result in interference fit, and the first recess sidewall is subject to deformation to facilitate combining the first frame and the second frame together.

In an embodiment, the elliptic bulge further includes a second major axis end, which is arranged at a second side of the elliptic bulge. During the first frame is combined with the second frame, the recess bottom surface is pushed by the second major axis end to result in interference fit.

In an embodiment, the first recess sidewall is arranged at a first side of the recess entrance. During the first frame is combined with the second frame and the first frame is swung with respect to the second frame, the first major axis end of the elliptic bulge is stopped by the first recess sidewall, thereby preventing detachment of the elliptic bulge from the recess.

In an embodiment, for combining the first frame with the second frame, the second major axis end is firstly introduced into the recess entrance and then the first frame is rotated to allow the first recess sidewall to be pushed by the second major axis end to result in interference fit, so that the first recess sidewall is subject to deformation to facilitate combining the first frame and the second frame together.

In an embodiment, the recess further includes a second recess sidewall, a first recess curved part and a second recess curved part. The second recess sidewall is arranged at a second side of the recess entrance. The first recess curved part is arranged between the first recess sidewall and the recess bottom surface. The second recess curved part is arranged between the second recess sidewall and the recess bottom surface. A distance between the first recess curved part and the second recess curved part is defined as the recess width.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
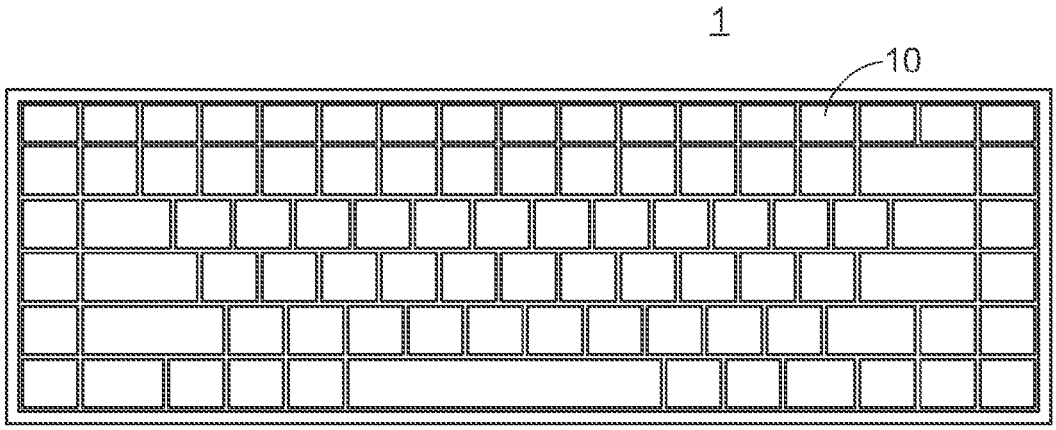
FIG.1 PRIOR ART
FIG. 1 is a schematic view illustrating the outward appearance of a conventional keyboard device.
Figure 2:
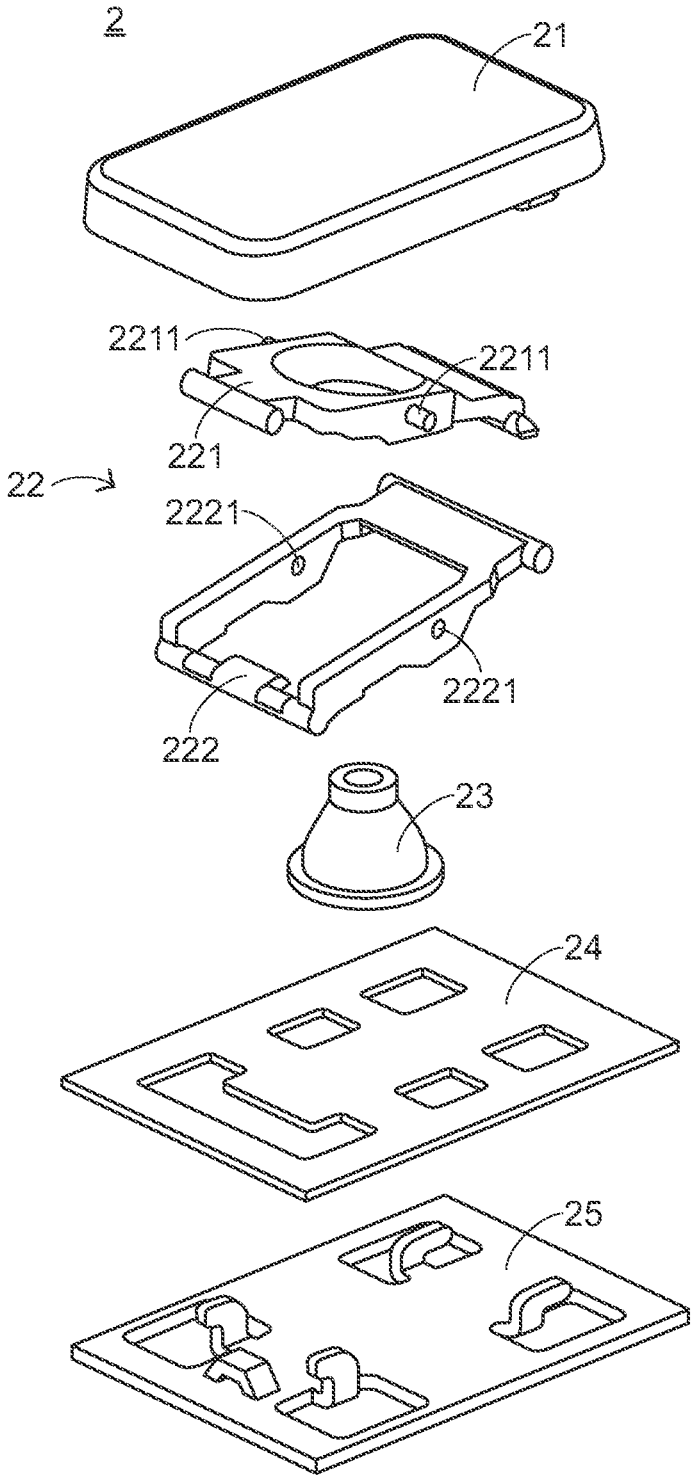
FIG.2 PRIOR ART
FIG. 2 is a schematic exploded view illustrating a key structure of a conventional keyboard device.
Figure 3:
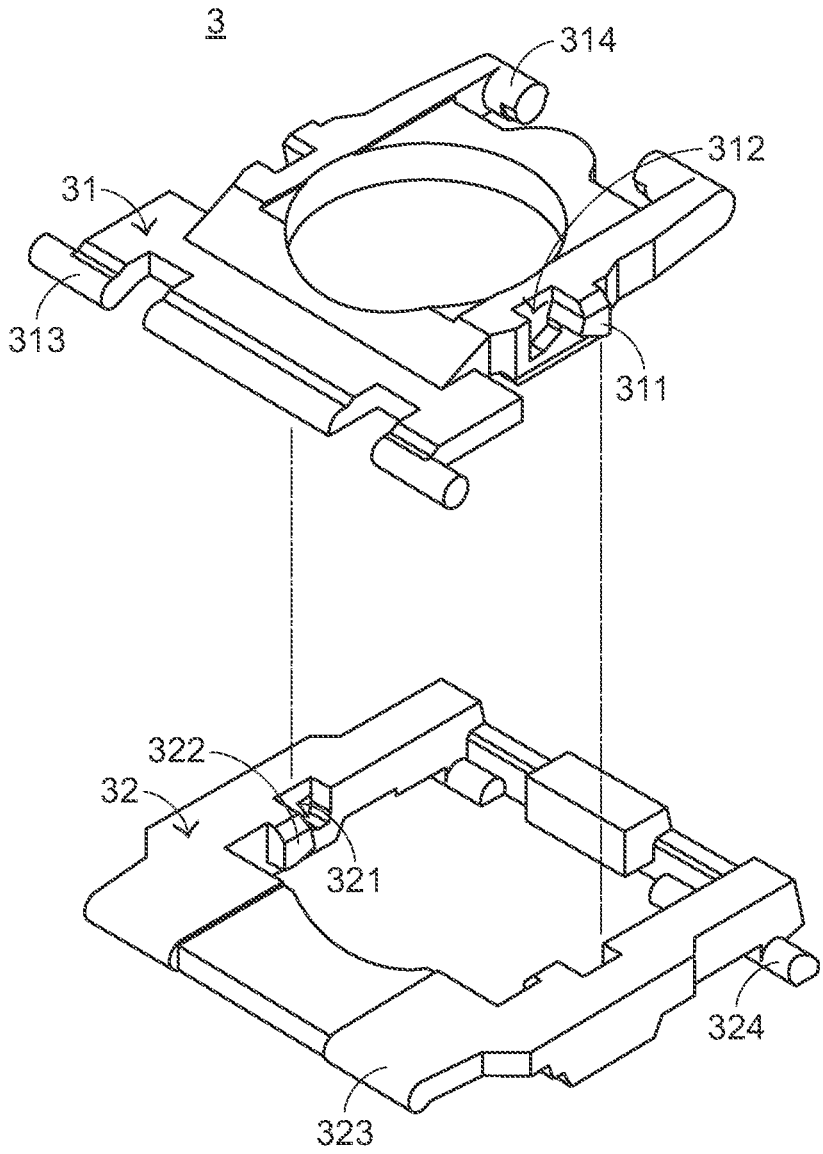
FIG.3 PRIOR ART
FIG. 3 is an exploded view illustrating another scissors-type connecting member of the conventional key structure.
Figure 4:
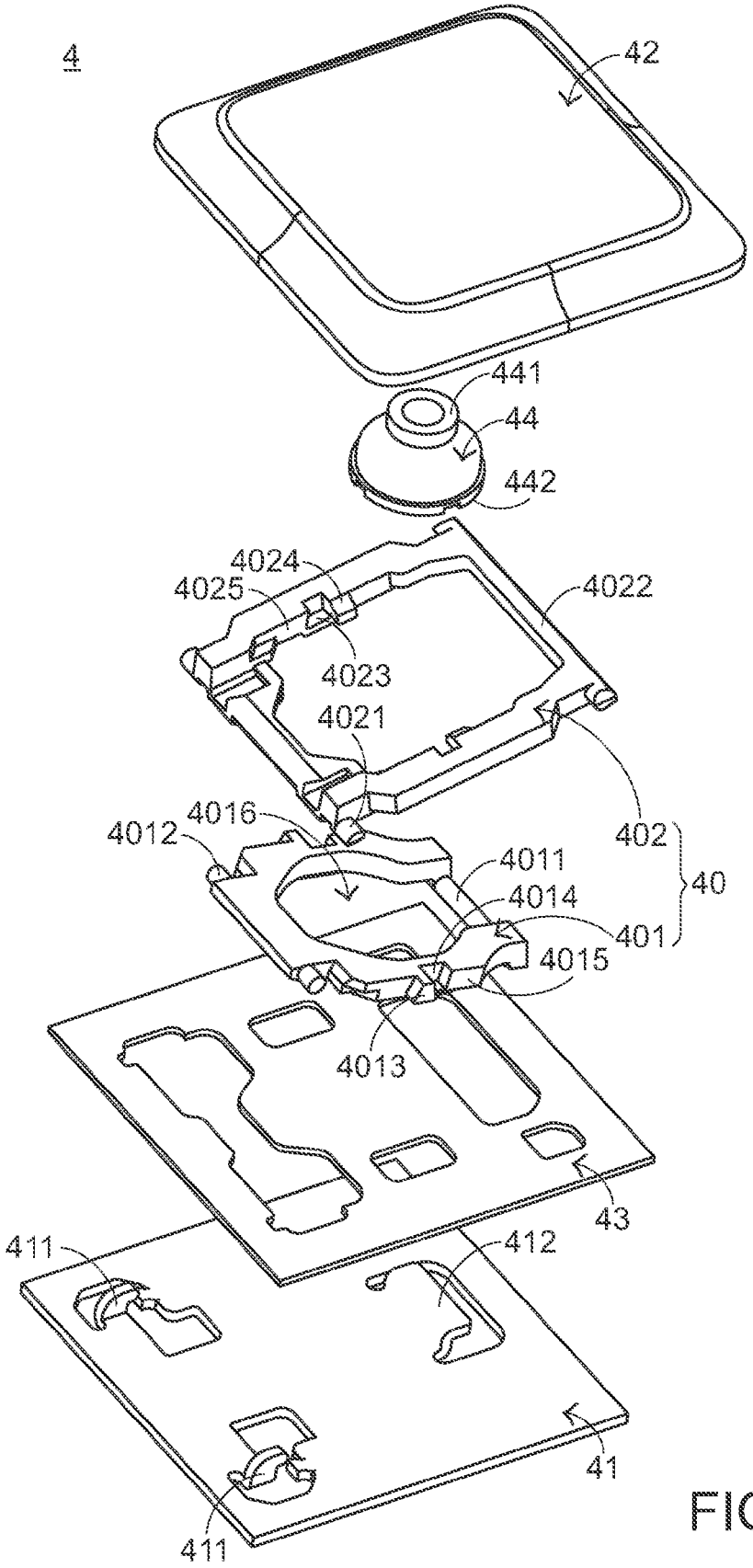
FIG. 4 is a schematic exploded view illustrating a key structure with a scissors-type connecting member according to a first embodiment of the present invention.

For obviating the drawbacks encountered from the prior art, the present invention provides a key structure with a scissors-type connecting member. FIG. 4 is a schematic exploded view illustrating a key structure with a scissors-type connecting member according to a first embodiment of the present invention. As shown in FIG. 4, the key structure 4 comprises a scissors-type connecting member 40, a base plate 41, a keycap 42, a membrane switch 43 and an elastic element 44. The scissors-type connecting member 40 is arranged between the keycap 42 and the membrane switch 43. The scissors-type connecting member 40 comprises a first frame 401 and a second frame 402. In this embodiment, the first frame 401 is an inner frame, and the second frame 402 is an outer frame. The first frame 401 comprises a base plate sliding shaft 4011, a keycap fixing shaft 4012, a bulge 4013, an auxiliary recess 4014 and a central hollow portion 4016. The keycap fixing shaft 4012 is arranged at a first end of the first frame 401 and connected with the keycap 42. The base plate sliding shaft 4011 is arranged at a second end of the first frame 401 and connected with the base plate 41. The bulge 4013 is arranged on a sidewall 4015 of the first frame 401. The auxiliary recess 4014 is formed in the sidewall 4015 of the first frame 401, and arranged beside the bulge 4013. The elastic element 44 is penetrated through the hollow portion 4016. The second frame 402 comprises a base plate fixing shaft 4021, a keycap sliding shaft 4022, a recess 4023 and an auxiliary bulge 4024. The base plate fixing shaft 4021 is arranged at a first end of the second frame 402 and connected with the base plate 41. The keycap sliding shaft 4022 is arranged at a second end of the second frame 402 and connected with the keycap 42. The recess 4023 is formed in a sidewall 4025 of the second frame 402. The auxiliary bulge 4024 is disposed on the sidewall 4025 of the second frame 402 and arranged beside the recess 4023.

Please refer to FIG. 4 again. The base plate 41 is disposed under the membrane switch 43. In addition, the base plate 41 comprises a base plate fixing hook 411 and a base plate sliding hook 412. The base plate fixing hook 411 is arranged at a first side of the base plate 41 and connected with the base plate fixing shaft 4021. The base plate sliding hook 412 is arranged at a second side of the base plate 41 and connected with the base plate sliding shaft 4011. The membrane switch 43 is arranged between the base plate 41 and the elastic element 44. When the membrane switch 43 is triggered, the membrane switch 43 issues a key signal. In addition, the elastic element 44 comprises an upper portion 441 and a lower portion 442. For combining the components of the key structure 4 together, the elastic element 44 is penetrated through the hollow portion 4016, the upper portion 441 of the elastic element 44 is in contact with the keycap 42, and the lower portion 442 of the elastic element 44 is in contact with the membrane switch 43.

Figure 5A:
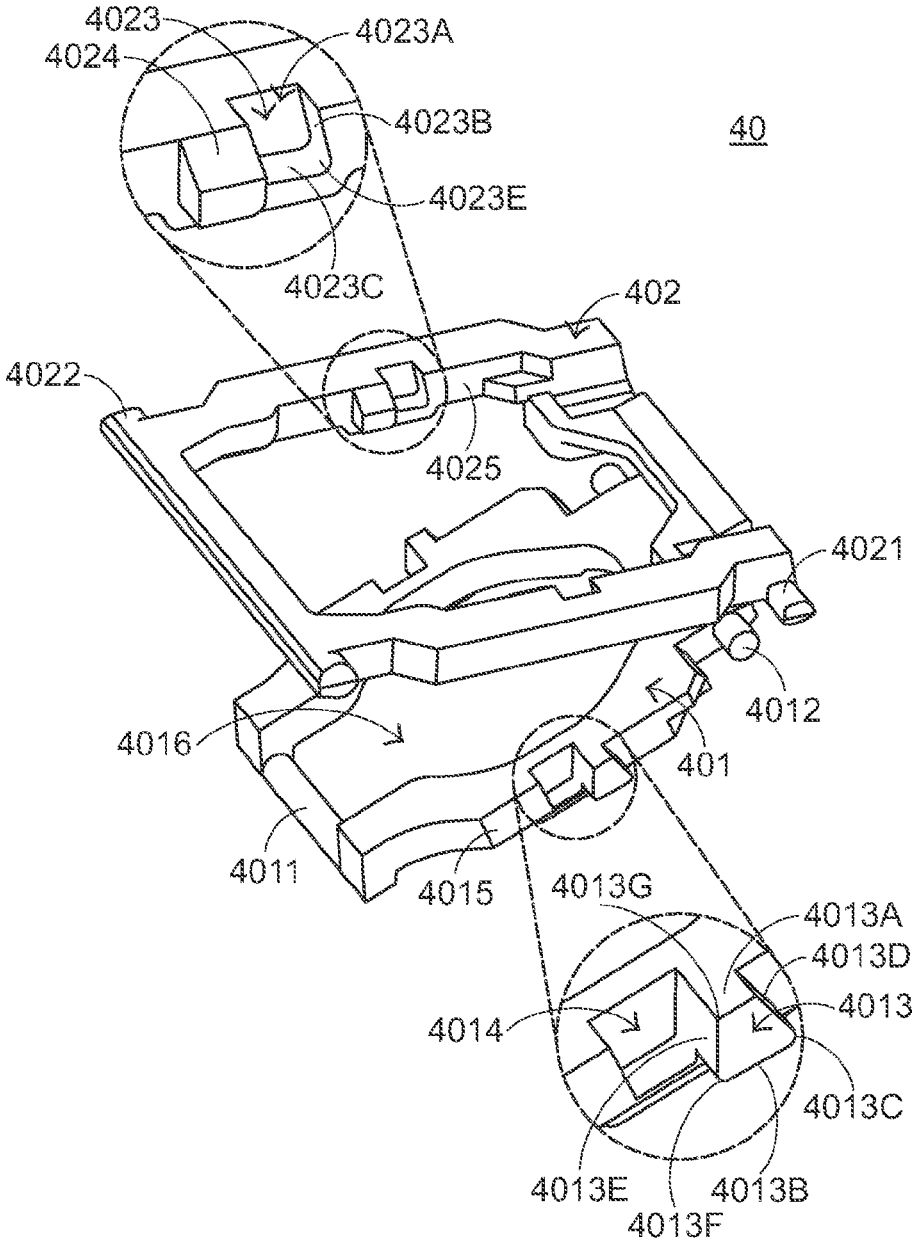
FIGS. 5A and 5B schematically illustrate the first frame and the second frame of the scissors-type connecting member of the key structure according to the first embodiment of the present invention.
Figure 5B:
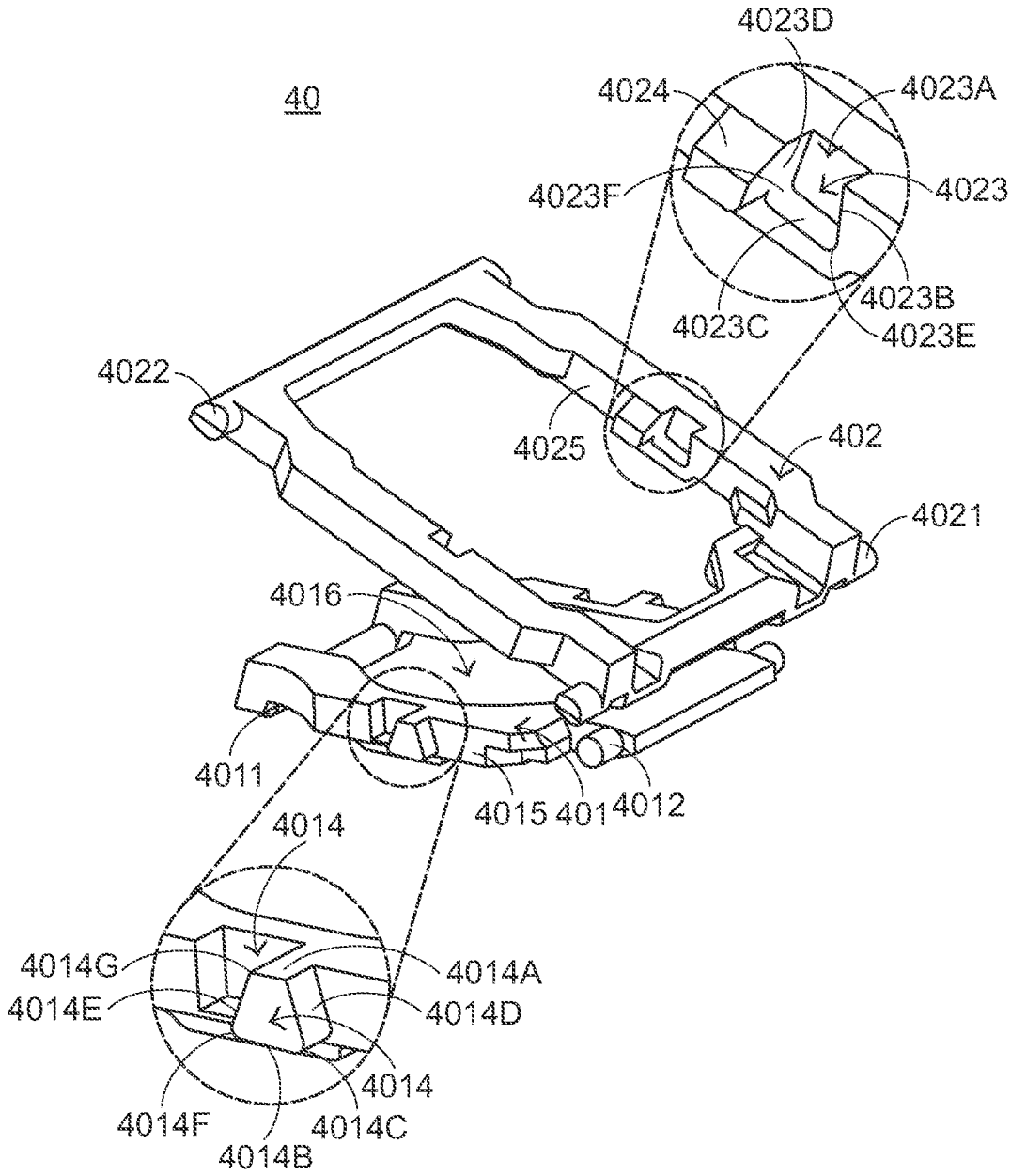

Hereinafter, the detailed configurations of the scissors-type connecting member 40 will be illustrated with reference to FIGS. 5A and 5B. FIGS. 5A and 5B schematically illustrate the first frame and the second frame of the scissors-type connecting member of the key structure according to the first embodiment of the present invention. In the first frame 401, the bulge 4013 comprises a bulge top surface 4013A, a bulge bottom surface 4013B, a first bulge curved part 4013C, a first bulge sidewall 4013D, a second bulge sidewall 4013E, a second bulge curved part 4013F and a third bulge curved part 4013G. In this embodiment, the first bulge curved part 4013C is a beveled round corner, the second bulge curved part 4013F is also a beveled round corner, and the third bulge curved part 4013G is a sharp corner. That is, the two beveled round corners of the bulge 4013 (i.e. the curvy regions) are referred as the first bulge curved part 4013C and the second bulge curved part 4013F, respectively. The distance between the first bulge curved part 4013C and the second bulge curved part 4013F is defined as a bulge width W1 (see FIG. 6A). In addition, the linear zone is defined as the bulge bottom surface 4013B.

Please refer to FIGS. 5A and 5B. The first bulge sidewall 4013D is arranged between the bulge top surface 4013A and the first bulge curved part 4013C. The second bulge sidewall 4013E is arranged at a first side of the bulge top surface 4013A. The first bulge curved part 4013C is arranged between the bulge bottom surface 4013B and the first bulge sidewall 4013D. The second bulge curved part 4013F is arranged between the bulge bottom surface 4013B and the second bulge sidewall 4013E. The third bulge curved part 4013G is arranged between the bulge top surface 4013A and the second bulge sidewall 4013E. In a preferred embodiment, the bulge top surface 4013A is not parallel with the bulge bottom surface 4013B. The height between the bulge top surface 4013A and the bulge bottom surface 4013B is defined as a bulge height H, and the distance between the first bulge curved part 4013C and the second bulge curved part 4013F is defined as a bulge width W1, wherein the bulge height H is smaller than the bulge width W1 (see FIG. 6A).

In the second frame 402, the recess 4023 has a recess entrance 4023A, a first recess sidewall 4023B, a recess bottom surface 4023C, a second recess sidewall 4023D, a first recess curved part 4023E and a second recess curved part 4023F. The first recess sidewall 4023B is arranged at a first side of the recess entrance 4023A. The second recess sidewall 4023D is arranged at a second side of the recess entrance 4023A. The first recess curved part 4023E is arranged between the first recess sidewall 4023B and the recess bottom surface 4023C. The second recess curved part 4023F is arranged between the second recess sidewall 4023D and the recess bottom surface 4023C. In a preferred embodiment, the recess entrance 4023A is not parallel with the recess bottom surface 4023C. In this embodiment, the length L1 of the recess entrance 4023A is greater than the bulge height H, the length L1 of the recess entrance 4023A is smaller than a recess width W2, and the length L1 of the recess entrance 4023A is smaller than the bulge width W1 (see FIG. 6A). The distance between the first recess curved part 4023E and the second recess curved part 4023F is defined as the recess width W2.

A process of combining the first frame 401 with the second frame 402 will be illustrated as follows. FIGS. 6A, 6B, 6C, 6D and 6E are schematic side views illustrating a process of combining the first frame with the second frame of the scissors-type connecting member of the key structure according to the first embodiment of the present invention.

Figure 6A:
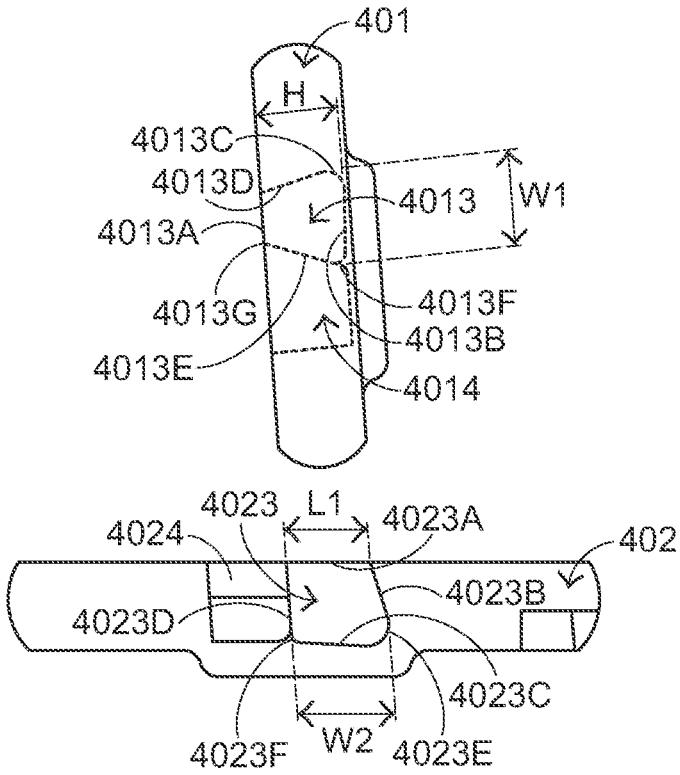
FIGS. 6A, 6B, 6C, 6D and 6E are schematic side views illustrating a process of combining the first frame with the second frame of the scissors-type connecting member of the key structure according to the first embodiment of the present invention.
Figure 6B:
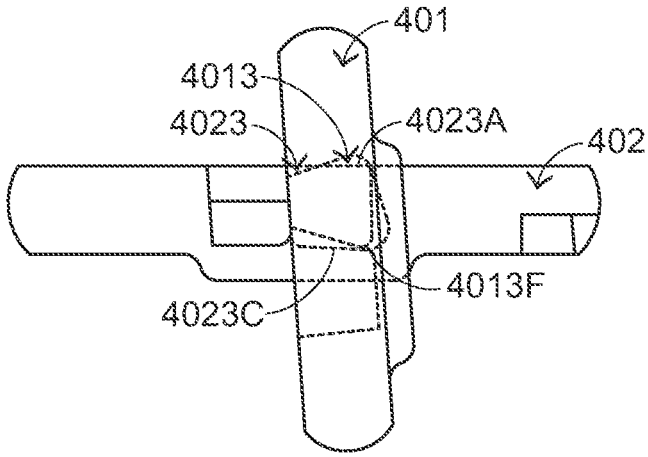
Figure 6C:
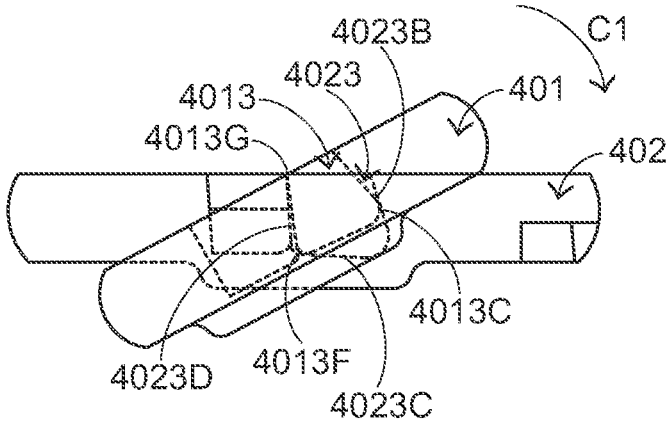
Figure 6D:
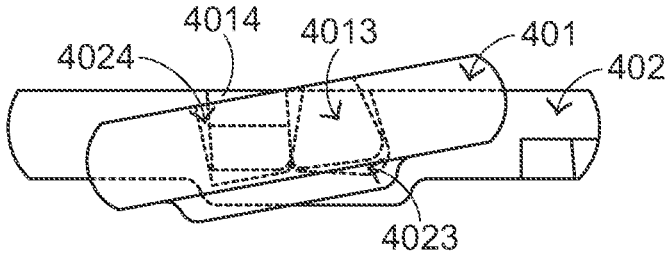
Figure 6E:
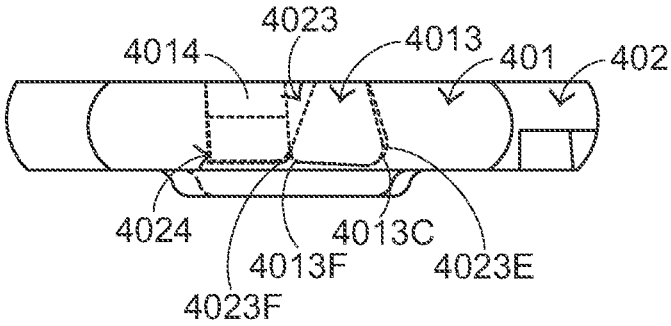

For combining the first frame 401 with the second frame 402, the included angle between the first frame 401 and the second frame 402 is firstly adjusted to be about 90 degrees (see FIG. 6A). Since the length L1 of the recess entrance 4023A is greater than the bulge height H, the bulge 4013 of the first frame 401 is allowed to pass through the recess entrance 4023A of the second frame 402. However, the first bulge curved part 4013C of the bulge 4013 is located outside the recess 4023, and the second bulge curved part 4013F of the bulge 4013 is in contact with the recess bottom surface 4023C (see FIG. 6B).

Figure 7:
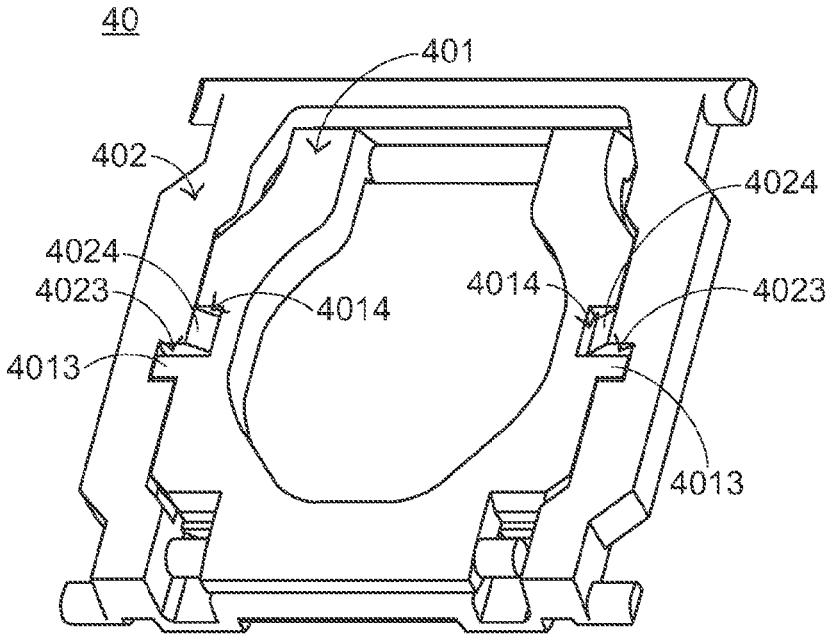
FIG. 7 is a schematic assembled view illustrating the scissors-type connecting member of the key structure according to the first embodiment of the present invention.

After the bulge 4013 is accommodated within the recess 4023, the first frame 401 is rotated in a first direction C1. Consequently, the first recess sidewall 4023B is pushed by the first bulge curved part 4013C of the bulge 4013 to result in interference fit (see FIG. 6C). At the same time, the second recess sidewall 4023D of the recess 4023 is pushed by the third bulge curved part 4013G of the bulge 4013 to result in interference fit, and the recess bottom surface 4023C of the recess 4023 is pushed by the second bulge curved part 4013F of the bulge 4013 to result in interference fit. As the first frame 401 is continuously rotated in the first direction C1, since the first recess sidewall 4023B is pushed by the first bulge curved part 4013C of the bulge 4013 to result in deformation, the first bulge curved part 4013C of the bulge 4013 is introduced into the recess 4023 and the auxiliary bulge 4024 is introduced into the auxiliary recess 4014 (see FIG. 6D). After the first bulge curved part 4013C of the bulge 4013 is introduced into the recess 4023, the first recess sidewall 4023B is no longer pushed by the first bulge curved part 4013C of the bulge 4013, and thus the first recess sidewall 4023B is returned to a former state. Afterwards, the first frame 401 and the second frame 402 are parallel with each other, so that the scissors-type connecting member 40 is in a folded state. Under this circumstance, the bulge 4013 is accommodated within the recess 4023, the auxiliary bulge 4024 is accommodated within the auxiliary recess 4014, the auxiliary bulge 4024 is in contact with the bulge 4013, the first bulge curved part 4013C of the bulge 4013 is in contact with the first recess curved part 4023E, and the second bulge curved part 4013F of the bulge 4013 is in contact with the second recess curved part 4023F (see FIGS. 6E and 7).

Please refer to FIG. 6D again. After the first bulge curved part 4013C of the bulge 4013 is introduced into the recess 4023 and the first frame 401 is swung with respect to the second frame 402 (i.e. the key structure 4 is depressed), since the length of the bulge bottom surface 4013B is greater than the length L1 of the recess entrance 4023A, the first bulge curved part 4013C of the bulge 4013 is stopped by the first recess sidewall 4023B from being out of the recess 4023. In such way, the possibility of separating the first frame 401 from the second frame 402 will be minimized.

Please refer to FIG. 4 again. When the keycap 42 of the key structure 4 is depressed, the base plate fixing shaft 4021 is rotated within the base plate fixing hook 411, and the base plate sliding shaft 4011 is moved within the base plate sliding hook 412 and toward the second side of the base plate 41. As a consequence, the first frame 401 of the scissors-type connecting member 40 is swung with respect to the second frame 402, and the bulge 4013 is pushed by the auxiliary bulge 4024 along the second bulge sidewall 4013E of the bulge 4013. Under this circumstance, the scissors-type connecting member 40 is changed from an open-scissors state to a folded state. Since the keycap 42 is moved downwardly to push against the elastic element 44, the membrane switch 43 is triggered by the elastic element 44 to generate a key signal.

Whereas, when the depressing force exerted on the keycap 42 is eliminated, an elastic force provided by the elastic element 44 is exerted on the keycap 42. Due to the elastic force, the base plate fixing shaft 4021 is rotated within the base plate fixing hook 411, and the base plate sliding shaft 4011 is moved within the base plate sliding hook 412 and toward the first side of the base plate 41. Consequently, the keycap 42 is moved to an original position where the keycap 42 has not been depressed. The configurations and operating principles of the key structure 4 according to the first embodiment of the present invention has been described above.

In this embodiment, the bulge height H of the bulge 4013 of the first frame 401 is smaller than the bulge width W1, the length L1 of the recess entrance 4023A of the recess 4023 is greater than the bulge height H, the length L1 of the recess entrance 4023A is smaller than the recess width W2, and the length L1 of the recess entrance 4023A is smaller than the bulge width W1. Due to the above structural features, the scissors-type connecting member 40 of the key structure 4 of the present invention may perform the following actions. That is, after the second bulge sidewall 4013E of the bulge 4013 is introduced into the recess 4023 of the second frame 402, the first frame 401 is rotated to combine the first frame 401 and the second frame 402 together. By the scissors-type connecting member 40 of the key structure 4 of the present invention, the first frame 401 and the second frame 402 are easily combined, and the possibility of detaching the first frame 401 from the second frame 402 is minimized.

Figure 8:
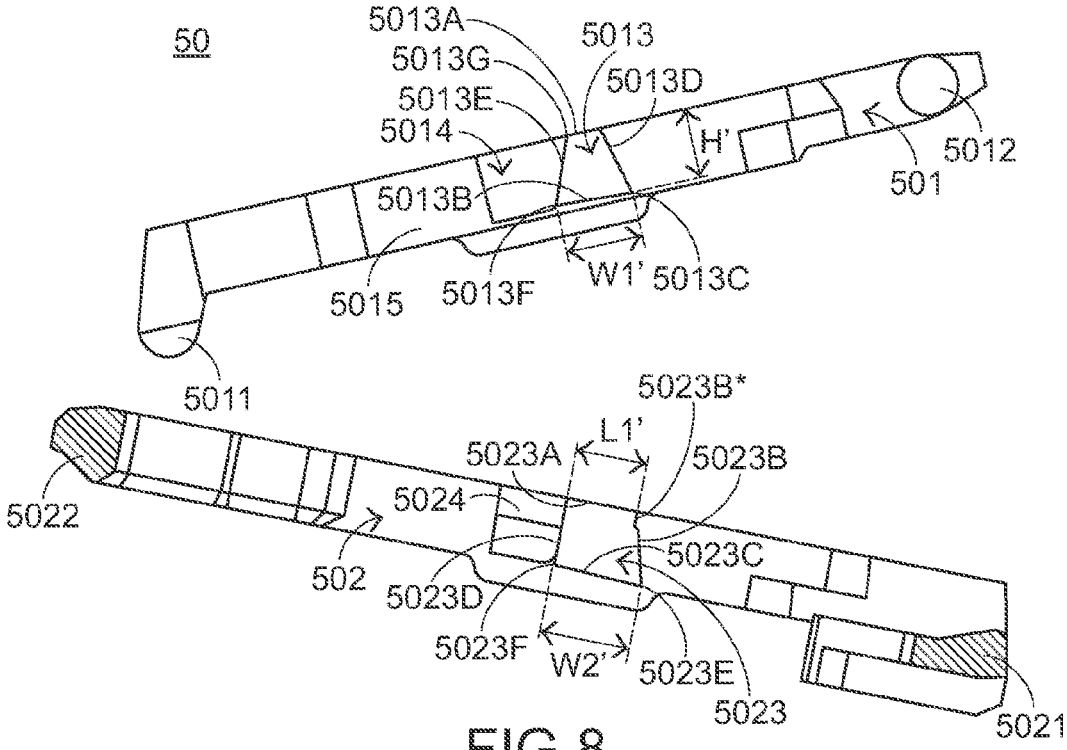
FIG. 8 is a schematic side view illustrating the first frame and the second frame of the scissors-type connecting member of the key structure according to a second embodiment of the present invention.

The present invention further provides a second embodiment of a key structure with a scissors-type connecting member. The base plate, the keycap, the membrane switch and the elastic element included in the key structure of the second embodiment are similar to those of the first embodiment, and are not redundantly described herein. Hereinafter, the scissors-type connecting member 50 of the key structure according to the second embodiment of the present invention will be illustrated with reference to FIG. 8. FIG. 8 is a schematic side view illustrating the first frame and the second frame of the scissors-type connecting member of the key structure according to a second embodiment of the present invention. As shown in FIG. 8, the scissors-type connecting member 50 comprises a first frame 501 and a second frame 502. The first frame 501 comprises a base plate sliding shaft 5011, a keycap fixing shaft 5012, a bulge 5013 and an auxiliary recess 5014. The second frame 502 comprises a base plate fixing shaft 5021, a keycap sliding shaft 5022, a recess 5023 and an auxiliary bulge 5024. The configurations of the base plate sliding shaft 5011, the keycap fixing shaft 5012 and the auxiliary recess 5014 of the first frame 501 and the base plate fixing shaft 5021, the keycap sliding shaft 5022 and the auxiliary bulge 5024 of the second frame 502 are similar to those of the first embodiment, and are not redundantly described herein. Whereas, the bulge 5013 and the recess 5023 are distinguished.

In this embodiment, the bulge 5013 comprises a bulge top surface 5013A, a bulge bottom surface 5013B, a first bulge curved part 5013C, a first bulge sidewall 5013D, a second bulge sidewall 5013E, a second bulge curved part 5013F and a third bulge curved part 5013G. The first bulge curved part 5013C and the second bulge curved part 5013F are both sharp corners. In addition, the recess 5023 has a recess entrance 5023A, a first recess sidewall 5023B, a recess bottom surface 5023C, a second recess sidewall 5023D, a first recess curved part 5023E and a second recess curved part 5023F. Moreover, a protrusion 5023B* is formed on the first recess sidewall 5023B and arranged beside the recess entrance 5023A. During the process of combining the first frame 501 with the second frame 502, the protrusion 5023B* is pushed by the first bulge curved part 5013C of the bulge 5013 to result in deformation. Consequently, the first bulge curved part 5013C is allowed to pass through the protrusion 5023B*, and then located between the protrusion 5023B* and the recess bottom surface 5023C. In such way, the first frame 501 and the second frame 502 are combined together. Moreover, the second bulge sidewall 5013E and the second bulge curved part 5013F are both sharp corners. The bulge top surface 5013A, the bulge bottom surface 5013B, the first bulge sidewall 5013D, the second bulge sidewall 5013E and the third bulge curved part 5013G of the first frame 501 and the recess entrance 5023A, the recess bottom surface 5023C and the second recess sidewall 5023D of the second frame 502 are similar to those of the first embodiment.

In this embodiment, during the process of combining the first frame 501 with the second frame 502, the bulge 5013 and the protrusion 5023B* are pushed together to result in interference fit, so that the protrusion 5023B* is subject to deformation. Therefore, during the process of fabricating the second frame 502, the thickness of the protrusion 5023B* may be varied according to the practical requirements. In such way, the interference amount between the protrusion 5023B* and the bulge 5013 may be adjusted to meet the practical requirements.

In this embodiment, the bulge height H' of the bulge 5013 of the first frame 501 is smaller than the bulge width W1', the length L1' of the recess entrance 5023A of the recess 5023 is greater than the bulge height H', the length L1' of the recess entrance 5023A is smaller than the recess width W2' (i.e. the distance between the first recess curved part 5023E and the second recess curved part 5023F), and the length L1' of the recess entrance 5023A is smaller than the bulge width W1'.

Figure 9:
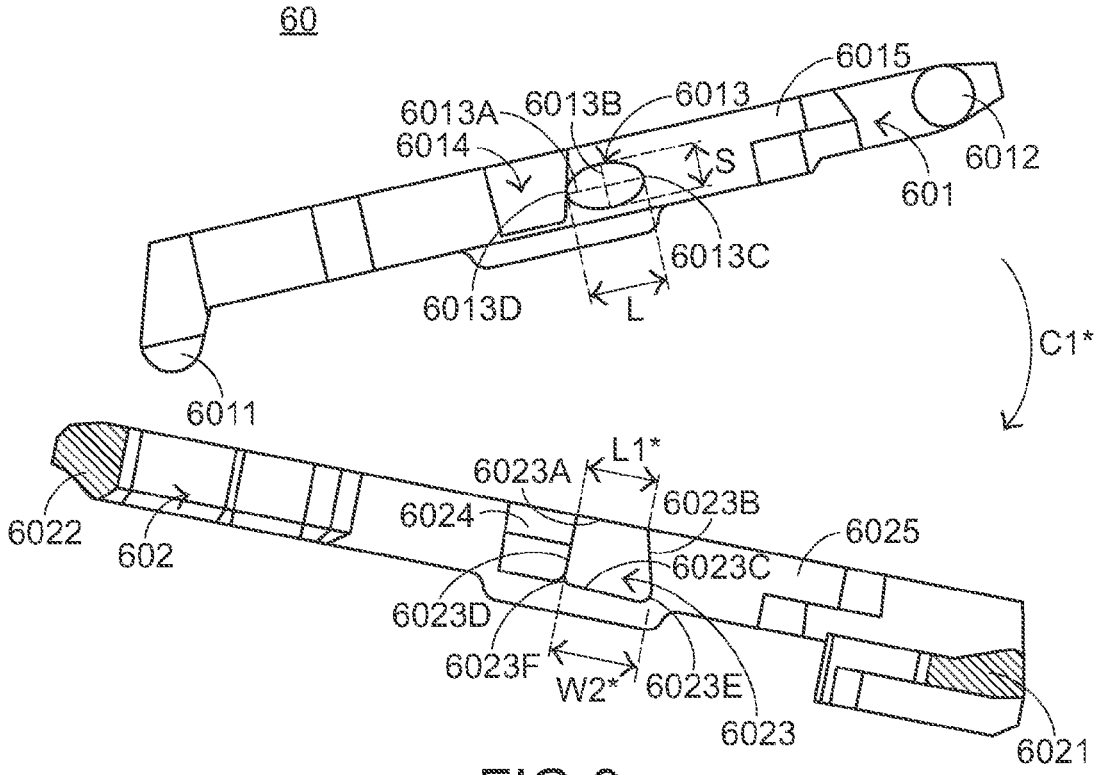
FIG. 9 is a schematic side view illustrating the first frame and the second frame of the scissors-type connecting member of the key structure according to a third embodiment of the present invention.

The present invention further provides a third embodiment of a key structure with a scissors-type connecting member. The base plate, the keycap, the membrane switch and the elastic element included in the key structure of the third embodiment are similar to those of the first embodiment, and are not redundantly described herein. Hereinafter, the scissors-type connecting member 60 of the key structure according to the third embodiment of the present invention will be illustrated with reference to FIG. 9. FIG. 9 is a schematic side view illustrating the first frame and the second frame of the scissors-type connecting member of the key structure according to a third embodiment of the present invention. As shown in FIG. 9, the scissors-type connecting member 60 comprises a first frame 601 and a second frame 602. The first frame 601 comprises a base plate sliding shaft 6011, a keycap fixing shaft 6012, an elliptic bulge 6013 and an auxiliary recess

6014. The elliptic bulge 6013 is arranged at a sidewall 6015 of the first frame 601. The second frame 602 comprises a base plate fixing shaft 6021, a keycap sliding shaft 6022, a recess 6023 and an auxiliary bulge 6024. The recess 6023 is formed in a sidewall 6025 of the second frame 602. In addition, the recess 6023 has a recess entrance 6023A, a first recess sidewall 6023B, a recess bottom surface 6023C, a second recess sidewall 6023D, a first recess curved part 6023E and a second recess curved part 6023F. In this embodiment, the length L1* of the recess entrance 6023A is smaller than the recess width W2*, and the distance between the first recess curved part 6023E and the second recess curved part 6023F is defined as the recess width W2*. The configurations of the base plate sliding shaft 6011, the keycap fixing shaft 6012 and the auxiliary recess 6014 of the first frame 601 and the second frame 602 are similar to those of the first embodiment, and are not redundantly described herein. Whereas, the elliptic bulge 6013 is distinguished.

In this embodiment, the elliptic bulge 6013 has a major axis 6013A, a minor axis 6013B, a first major axis end 6013C and a second major axis end 6013D. The length of the major axis 6013A is L, and the length of the minor axis 6013B is S. The length L of the major axis 6013A is greater than the length S of the minor axis 6013B. In addition, the length L of the major axis 6013A is greater than the length L1* of the recess entrance 6023A, and the length S of the minor axis 6013B is smaller than the length L1* of the recess entrance 6023A. The first major axis end 6013C is arranged at a first side of the elliptic bulge 6013. The second major axis end 6013D is arranged at a second side of the elliptic bulge 6013.

For combining the first frame 601 with the second frame 602, the included angle between the first frame 601 and the second frame 602 is firstly adjusted to be about 90 degrees. Since the length L1* of the recess entrance 6023A is greater than the length S of the minor axis 6013B, the elliptic bulge 6013 of the first frame 601 is allowed to pass through the recess entrance 6023A of the second frame 602. However, the first major axis end 6013C of the elliptic bulge 6013 is located outside the recess 6023. Then, the elliptic bulge 6013 is pushed to be introduced into the recess 6023 such that the second major axis end 6013D of the elliptic bulge 6013 is in contact with the recess bottom surface 6023C.

After the elliptic bulge 6013 is accommodated within the recess 6023, the first frame 601 is rotated in a first direction C1*. Consequently, the first recess sidewall 6023B is pushed by the first major axis end 6013C of the elliptic bulge 6013 to result in interference fit. At the same time, the recess bottom surface 6023C is pushed by the second major axis end 6013D of the elliptic bulge 6013 to result in interference fit. As the first frame 601 is continuously rotated in the first direction C1*, since the first recess sidewall 6023B is pushed by the first major axis end 6013C of the elliptic bulge 6013 to result in deformation, the first major axis end 6013C of the elliptic bulge 6013 is introduced into the recess 6023 and the auxiliary bulge 6024 is introduced into the auxiliary recess 6014. After the first major axis end 6013C of the elliptic bulge 6013 is introduced into the recess 6023, the first recess sidewall 6023B is no longer pushed by the first major axis end 6013C of the elliptic bulge 6013, and thus the first recess sidewall 6023B is returned to a former state. Since the length L of the major axis 6013A of the elliptic bulge 6013 is greater than the length L1* of the recess entrance 6023A, the elliptic bulge 6013 is stopped from being out of the recess 6023. After the first frame 601 and the second frame 602 are combined together and the first frame 601 is swung with respect to the second frame 602, the first major axis end 6013C of the elliptic bulge 6013 is stopped by the first recess sidewall 6023B. In such way, the possibility of detaching the elliptic bulge 6013 from the recess 6023 will be minimized.

In the above embodiments, the first frame is an inner frame, and the second frame is an outer frame. It is noted that the first frame and the second frame are not restricted to the inner frame and the outer frame, respectively. In some embodiments, the first frame is an outer frame, and the second frame is an inner frame.

From the above description, in the scissors-type connecting member of the key structure of the present invention, the recess of the second frame is a pocket-shaped recess, wherein the recess entrance is smaller than the recess bottom surface. The bulge of the first frame in the horizontal direction (or nearly the horizontal direction) is longer than the bulge of the first frame in the vertical direction (or nearly the vertical direction). In addition, the bulge of the first frame in the vertical direction (or nearly the vertical direction) is shorter than the recess entrance. After the shorter portion of the bulge is introduced into the recess through the recess entrance, the first frame is rotated to allow the recess sidewall to be pushed by the bulge to result in deformation of the recess sidewall. Due to deformation of the recess sidewall, the bulge is completely accommodated within the recess, so that the first frame and the second frame are combined together. After the first frame and the second frame are combined together, since the bulge in the horizontal direction (or nearly the horizontal direction) is longer than the recess entrance, the bulge is stopped from being out of the recess. Under this circumstance, the possibility of detaching the bulge from the recess is minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A key structure with a scissors-type connecting member, said key structure comprising:

a base plate;

a keycap disposed over said base plate; and said scissors-type connecting member arranged between said base plate and said keycap for connecting said base plate with said keycap, so that said keycap is moved upwardly or upwardly with respect to said base plate, wherein said scissors-type connecting member comprises:

a first frame having a bulge formed on a sidewall of said first frame, wherein said bulge comprises a bulge top surface and a bulge bottom surface, and a bulge height between said bulge top surface and said bulge bottom surface is smaller than a bulge width of said bulge, wherein said bulge further comprises:

a first bulge sidewall arranged between said bulge top surface and said first bulge curved part, wherein said first bulge sidewall is flat; and a second bulge sidewall arranged at a first side of said bulge top surface, wherein said second bulge sidewall is flat; and a second frame connected with said first frame, and comprising a recess in a sidewall of said second frame, wherein said bulge is accommodated within said recess when said first frame and said second frame are combined together, wherein said recess has a recess entrance, a first recess sidewall and a recess bottom surface, wherein a length of said recess entrance is greater than said bulge height, said length of said recess entrance is smaller than a recess width of said recess, and said length of said recess entrance is smaller than said bulge width, wherein when said first frame is combined with said second frame, said first recess sidewall is pushed by a first bulge curved part of said bulge to result in interference fit, and said first recess sidewall is subject to deformation to facilitate combining said first frame and said second frame together.

2. The key structure according to claim 1 wherein said bulge further comprises:

a second bulge curved part arranged between said bulge bottom surface and said second bulge sidewall, wherein when said first frame is combined with said second frame, said recess bottom surface is pushed by said second bulge curved part to result in interference fit, wherein a distance between said first bulge curved part and said second bulge curved part is defined as said bulge width.

3. The key structure according to claim 2 wherein said first recess sidewall is arranged at a first side of said recess entrance, wherein when said first frame is combined with said second frame and said first frame is swung with respect to said second frame, said first bulge curved part of said bulge is stopped by said first recess sidewall, thereby preventing detachment of said bulge from said recess.

4. The key structure according to claim 2 wherein said recess further comprises:

a second recess sidewall arranged at a second side of said recess entrance, wherein when said first frame is combined with said second frame, said second recess sidewall is pushed by a third bulge curved part of said bulge to result in interference fit;

a first recess curved part arranged between said first recess sidewall and said recess bottom surface; and a second recess curved part arranged between said second recess sidewall and said recess bottom surface, wherein a distance between said first recess curved part and said second recess curved part is defined as said recess width.

5. The key structure according to claim 4 wherein each of said first bulge curved part, said second bulge curved part, said first recess curved part and said second recess curved part is a beveled round corner or a sharp corner.

6. The key structure according to claim 2 wherein for combining said first frame with said second frame, said second bulge curved part is firstly introduced into said recess entrance and then said first frame is rotated to allow said first recess sidewall to be pushed by said first bulge curved part of said bulge to result in interference fit, so that said first recess sidewall is subject to deformation to facilitate combining said first frame and said second frame together.

7. The key structure according to claim 1 wherein a protrusion is further formed on the first recess sidewall and arranged beside said recess entrance, wherein when said first frame is combined with said second frame, said protrusion is pushed by said first bulge curved part of said bulge to result in deformation, so that said first curved part is allowed to pass through said protrusion to be located between said protrusion and said recess bottom surface to facilitate combining said first frame and said second frame together.

8. The key structure according to claim 1 wherein said second frame further comprises an auxiliary bulge, which is arranged between said sidewall of said second frame and beside said recess, wherein when said first frame is swung with respect to said second frame, said auxiliary bulge is in contact with said bulge.

9. The key structure according to claim 8 wherein said first frame further comprises an auxiliary recess, which is arranged between said sidewall of said first frame and beside said bulge, wherein when said first frame is swung with respect to said second frame, said auxiliary bulge is accommodated within said auxiliary recess.

10. The key structure according to claim 1 wherein said first frame is an inner frame, said second frame is an outer frame, said first frame is disposed within said second frame, and said first frame has a central hollow portion.

11. The key structure according to claim 1 wherein said first frame is an outer frame, said second frame is an inner frame, said second frame is disposed within said first frame, and said second frame has a central hollow portion.

12. The key structure according to claim 1 further comprising:

a membrane switch disposed on said base plate, wherein when said membrane switch is triggered, said membrane switch generates a key signal; and an elastic element disposed on said membrane switch, wherein a lower portion of said elastic element is in contact with said membrane switch, wherein said elastic element is penetrated through said scissors-type connecting member and an upper portion of said elastic element is in contact with said keycap, wherein when said elastic element is pushed by said keycap, said membrane switch is triggered by said elastic element, wherein when a depressing force exerted on said keycap is eliminated, an elastic force provided by said elastic element is exerted on said keycap.

13. The key structure according to claim 12 wherein when said keycap is depressed, said first frame is swung with respect to said second frame, so that said scissors-type connecting member is changed from an open-scissors state to a folded state and said elastic element is pushed by said keycap to trigger said membrane switch to generate said key signal, wherein when said depressing force exerted on said keycap is eliminated, said elastic force provided by said elastic element is exerted on said keycap, and said first frame is swung with respect to said second frame, so that said scissors-type connecting member is changed from said folded state to said open-scissors state and said keycap is moved to an original position.

14. A key structure with a scissors-type connecting member, said key structure comprising:

a base plate;

a keycap disposed over said base plate; and said scissors-type connecting member arranged between said base plate and said keycap for connecting said base plate with said keycap, so that said keycap is moved upwardly or upwardly with respect to said base plate, wherein said scissors-type connecting member comprises:

a first frame having an elliptic bulge formed on a sidewall of said first frame, wherein said elliptic bulge has a major axis and a minor axis, wherein said minor axis is shorter than said major axis; and a second frame connected with said first frame, and comprising a recess in a sidewall of said second frame, wherein said elliptic bulge is accommodated within said recess when said first frame and said second frame are combined together, wherein said recess has a recess entrance, a first recess sidewall and a recess bottom surface, wherein a length of said recess entrance is greater than a length of said minor axis, said length of said recess entrance is smaller than a recess width of said recess, and said length of said recess entrance is smaller than a length of said major axis, wherein when said first frame is combined with said second frame, said first recess sidewall is pushed by a first major axis end of said elliptic bulge to result in interference fit, and said first recess sidewall is subject to deformation to facilitate combining said first frame and said second frame together.

15. The key structure according to claim 14 wherein said elliptic bulge further comprises a second major axis end, which is arranged at a second side of said elliptic bulge, wherein when said first frame is combined with said second frame, said recess bottom surface is pushed by said second major axis end to result in interference fit.

16. The key structure according to claim 15 wherein said first recess sidewall is arranged at a first side of said recess entrance, wherein when said first frame is combined with said second frame and said first frame is swung with respect to said second frame, said first major axis end of said elliptic bulge is stopped by said first recess sidewall, thereby preventing detachment of said elliptic bulge from said recess.

17. The key structure according to claim 15 wherein for combining said first frame with said second frame, said second major axis end is firstly introduced into said recess entrance and then said first frame is rotated to allow said first recess sidewall to be pushed by said second major axis end to result in interference fit, so that said first recess sidewall is subject to deformation to facilitate combining said first frame and said second frame together.

18. The key structure according to claim 14 wherein said recess further comprises:

a second recess sidewall arranged at a second side of said recess entrance;

a first recess curved part arranged between said first recess sidewall and said recess bottom surface; and a second recess curved part arranged between said second recess sidewall and said recess bottom surface, wherein a distance between said first recess curved part and said second recess curved part is defined as said recess width.

* * * * *